US006457757B2

(12) United States Patent
Hendrick

(10) Patent No.: US 6,457,757 B2
(45) Date of Patent: Oct. 1, 2002

(54) SNOW SHOVELING APPARATUS WITH HANDLE AND BLADE ADJUSTABLE DURING MOVEMENT OF APPARATUS

(76) Inventor: John D. Hendrick, 5030 W. Maplewood Pl., Littleton, CO (US) 80123

( * ) Notice: Subject to any disclaimer, the term of this patent is extended or adjusted under 35 U.S.C. 154(b) by 0 days.

(21) Appl. No.: 09/753,392

(22) Filed: Jan. 2, 2001

Related U.S. Application Data

(60) Provisional application No. 60/175,148, filed on Jan. 7, 2000.

(51) Int. Cl.[7] ..... A01B 1/22; E01H 5/02

(52) U.S. Cl. ..... 294/54.5; 294/53.5; 294/57; 37/265; 37/285

(58) Field of Search ..... 294/51, 53.5, 54.5, 294/57; 37/265, 283, 284, 285

(56) References Cited

U.S. PATENT DOCUMENTS

| | | | | | |
|---|---|---|---|---|---|
| 1,196,206 | A | * | 8/1916 | Bulger et al. | 294/53.5 |
| 2,460,560 | A | | 2/1949 | Williams | 37/53 |
| 2,653,397 | A | | 9/1953 | Butler | 37/53 |
| 2,715,786 | A | | 8/1955 | Dorko | 37/53 |
| 2,720,043 | A | | 10/1955 | Chamberlin | 37/53 |
| 2,803,071 | A | | 8/1957 | Pochopien | 37/53 |
| 2,908,090 | A | | 10/1959 | Eifel | 37/53 |
| 2,967,363 | A | * | 1/1961 | Meier | 294/53.5 |
| 3,017,710 | A | * | 1/1962 | Carlson | 280/47.26 |
| 3,994,081 | A | | 11/1976 | Middleton | 37/46 |
| 4,910,893 | A | | 3/1990 | Asay | 37/281 |
| 5,074,064 | A | | 12/1991 | Nickels | 37/265 |
| 5,271,169 | A | | 12/1993 | Konsztowicz | 37/271 |
| 5,630,633 | A | * | 5/1997 | Dupre et al. | 294/53.5 |
| 5,727,829 | A | * | 3/1998 | Bellichak | 15/111 |
| 6,315,341 | B1 | * | 11/2001 | Leon et al. | 294/53.5 |

* cited by examiner

*Primary Examiner*—Dean J. Kramer
(74) *Attorney, Agent, or Firm*—Flanagan & Flanagan; John R. Flanagan

(57) ABSTRACT

A snow shoveling apparatus includes a handle mounted to an intermediate portion of a base of a mobile frame such that the handle can undergo pivotal movement between selected vertical angles relative to the base, a tool mounted to a front end of the base such that the tool can undergo pivotal movement between selected horizontal angles relative to the base, a handle angle adjustment mechanism adapted to undergo relative reciprocal movement between latched and unlatched positions so as to allow changing of the vertical angle of the handle relative to the base when the mechanism is in the unlatched position and to hold the handle at a selected one of the vertical angles relative to the base when the mechanism is in the latched position, and a tool angle adjustment mechanism adapted to undergo relative pivotal movement between latched and unlatched positions as to allow changing of the horizontal angle of the tool relative to the base when the mechanism is in the unlatched position and to hold the tool at a selected one of the horizontal angles relative to the base when the mechanism is in the latched position.

29 Claims, 4 Drawing Sheets

SNOW SHOVELING APPARATUS WITH HANDLE AND BLADE ADJUSTABLE DURING MOVEMENT OF APPARATUS

This utility patent application claims the benefit of provisional application No. 60/175,148 filed Jan. 7, 2000.

BACKGROUND OF THE INVENTION

1. Field of the Invention

The present invention generally relates to snow shovels and, more particularly, is concerned with a snow shoveling apparatus having a handle and a blade that are adjustable during movement of the apparatus.

2. Description of the Prior Art

The manual movement and removal of snow is necessary in many areas around the world. Snow shovels are often employed for this purpose. Many types of snow shovels with various designs have been developed over the years. It is often desirable to adjust snow shovels for use in different locations and by different users. Many of the prior art snow shovels have features which allow them to be adjusted at the blade and/or at the handle.

Representative examples of prior art snow shovels are disclosed in U.S. Pat. No. 2,460,560 to Williams, U.S. Pat. No. 2,653,397 to Butler, U.S. Pat. No. 2,715,786 to Dorko, U.S. Pat. No. 2,803,071 to Pochopien, U.S. Pat. No. 2,908,090 to Eifel, U.S. Pat. No. 3,994,081 to Middleton, U.S. Pat. No. 4,910,893 to Asay and U.S. Pat. No. 5,271,169 to Konsztowicz. Each of the patents to Butler, Dorko, Pochopien, Middleton and Asay discloses a mechanism for articulating a blade of a snow shovel between left and right positions. Each of the patents to Williams, Eifel and Konsztowicz discloses a mechanism for articulating a blade of a snow shovel between upward and downward positions or tilting the blade relative to a support frame of the snow shovel. The patent to Asay also discloses a handle of a snow shovel which may be adjusted in order to accommodate different heights of users or to obtain a certain mechanical advantage over the snow to be removed.

A problem exists, however, with these prior art snow shovels in that none of the above-mentioned patents appears to disclose a handle and a blade which can be easily adjusted while the snow shovel is being moved. Consequently, a need remains for an innovation which will overcome this problem without introducing any new problems in place thereof.

SUMMARY OF THE INVENTION

The present invention provides a snow shoveling apparatus that satisfies the aforementioned need. The snow shoveling apparatus of the present invention has a handle and a tool, such as a blade, which are adjustable independently of one another and during movement of the apparatus over a surface. Hereinafter, the manual pushing, lifting, casting and/or plowing of snow and other materials, such as gravel, soil and sand, for the sake of brevity will be referred to simply as snow shoveling and so it will be understood that the apparatus of the present invention is useful in the performance of any these activities.

Accordingly, the present invention is directed to a snow shoveling apparatus which comprises: (a) a mobile frame having an elongated base with opposite front and rear ends; (b) a handle; (c) means for mounting the handle to an intermediate portion of the base of the frame located between and spaced from the opposite front and rear ends thereof such that the handle can undergo pivotal movement between selected vertical angles relative to the base; (d) a handle angle adjustment mechanism having one component mounted to the handle and another component mounted adjacent to the intermediate portion of the base such that the components are adapted to undergo relative reciprocal movement between latched and unlatched positions so as to allow changing of the vertical angle of the handle relative to the base when the components are in the unlatched position and to hold the handle at a selected one of the vertical angles relative to the base when the components are in the latched position; (e) a tool; and (f) means for mounting the tool to the front end of the base of the frame.

The present invention also is directed to a snow shoveling apparatus which comprises: (a) a mobile frame having an elongated base with opposite front and rear ends; (b) a handle; (c) means for mounting the handle to an intermediate portion of the base located between and spaced from the opposite front and rear ends thereof; (d) a tool; (e) means for mounting the tool to the front end of the base such that the tool can undergo pivotal movement between selected horizontal angles relative to the base; and (f) a tool angle adjustment mechanism having one component mounted to the tool mounting means and another component mounted to the base forwardly of the intermediate portion thereof such that the components of the tool angle adjustment mechanism are adapted to undergo relative pivotal movement between locked and unlocked positions so as to allow changing of the horizontal angle of the tool relative to the base when the components are in the unlocked position and to hold the tool at a selected one of the horizontal angles relative to the base when the components are in the locked position.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
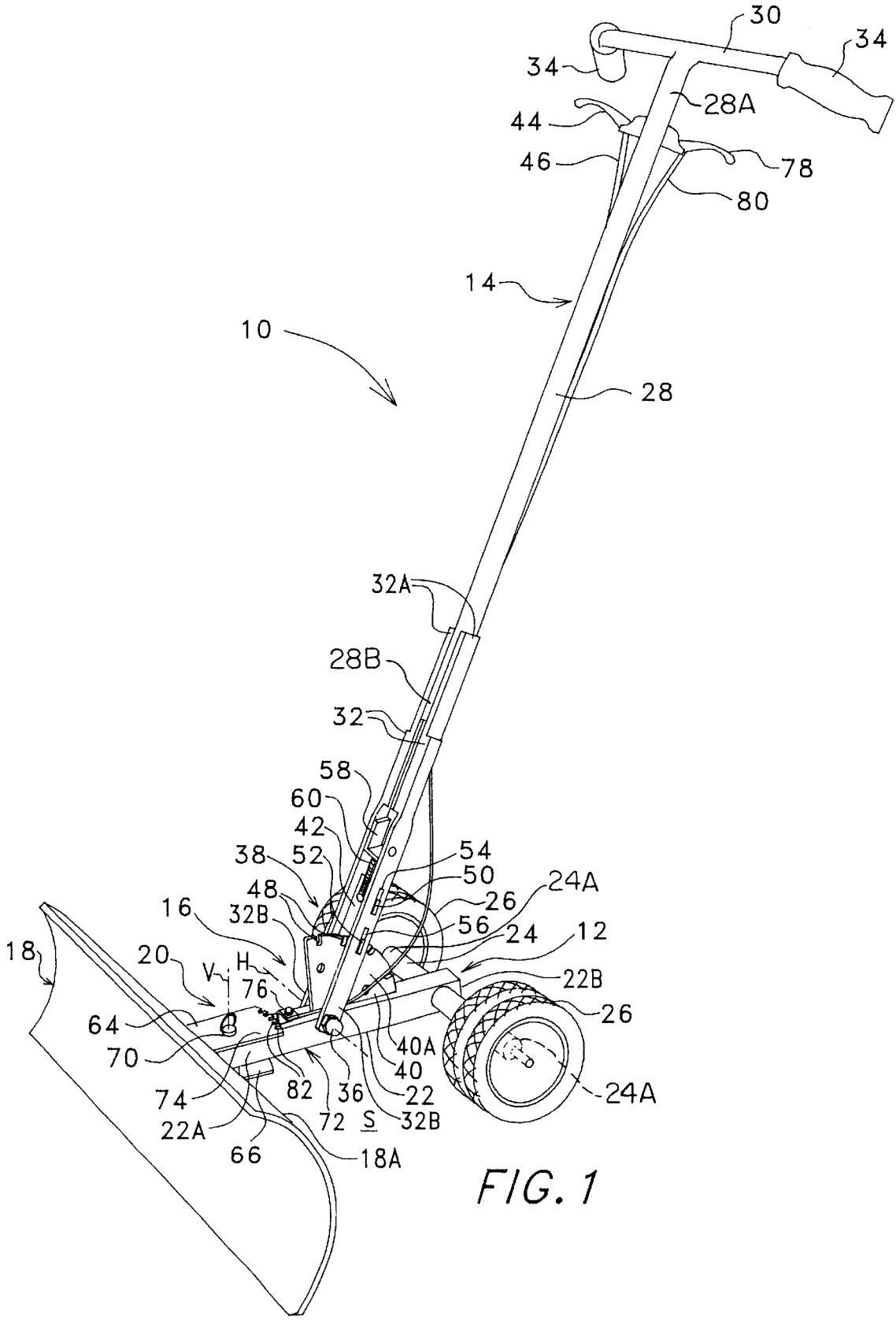
FIG. 1 is a perspective view of a snow shoveling apparatus of the present invention.

Referring to the drawings and particularly to FIG. 1, there is illustrated a snow shoveling apparatus of the present invention, generally designated 10. The apparatus 10 basically includes a mobile frame 12, a handle 14, a handle mounting and adjusting means 16, a tool or implement 18 and a tool mounting and adjusting means 20.

In the illustrated embodiment, the mobile frame 12 of the apparatus 10 includes a base 22, an axle 24 and a pair of wheels 26. The base 22 made of a substantially rigid material, such as a metal or the like, is elongated and has a substantially rectangular cross-sectional configuration, although it may have any other suitable shape. The base 22 has opposite front and rear ends 22A, 22B and a length extending therebetween which is substantially greater than a width thereof. The axle 24 made of a substantially rigid material, such as metal or the like, is elongated and has a substantially cylindrical cross-sectional configuration. The axle 24 is fixedly mounted through the rear end 22B of the base 22 of the frame 12 so as to extend in a transverse relation thereto and in opposite directions therefrom. The axle 24 has opposite ends 24A laterally spaced in opposite directions from the base 22 and rotatably mounting the wheels 26 which are of any suitable type. The wheels 26 provide lateral stability of the frame 12, preferably are identical to one another and are in the form of dual wheels. The wheels 26 are rotatable in clockwise or counterclockwise directions relative to the base 22 and axle 24 such that the frame 12 of the apparatus 10 may be moved along a surface S by means of pushing or pulling on the handle 14.

The handle 14 of the apparatus 10 includes an elongated main tubular member 28 having opposite upper and lower ends 28A, 28B, a handlebar 30 fixedly attached on the upper end 28A of the main tubular member 28 and a pair of spaced apart side brackets 32 at their upper ends 32A disposed along opposite sides of and fixedly attached to the lower end 28B of the main tubular member 28 and extending downwardly therefrom generally parallel to one another. The handlebar 30 extends in a transverse relation to the main tubular member 28 and has opposite ends which support hand grips 34 thereon. The side brackets 32 at their lower ends 32B are disposed along opposite sides of the base 22 of the frame 12 at a location intermediately between the opposite ends 22A, 22B thereof. The main tubular member 28 of the handle 14 can have a substantially cylindrical configuration in cross-section or any other suitable cross-sectional configuration. The main tubular member 28, handlebar 30 and side brackets 32 of the handle 14 are made of a substantially rigid material, such as metal or the like.

Referring now to FIGS. 1 to 5, the handle mounting and adjusting means 16 of the apparatus 10 includes a connector pin 36 and a handle angle adjustment mechanism 38. These components are comprised of a substantially rigid material, such as metal or the like. The handle 14 is pivotally mounted via the lower ends 32B of the side brackets 32 thereof at the intermediate location on the frame base 22 by the connector pin 36. The connector pin 36 extends through aligned holes in the sides of the frame base 22 and holes in the lower ends 32B of the side brackets 32 and defines a generally horizontal axis H about which the handle 14 is pivotally movable in a generally vertical plane and through a vertical angle relative to the frame base 22. The handle angle adjustment mechanism 38 is operable to hold the handle 14 at a desired selected vertical angle relative to the frame base 22 and thus to hold the handlebar 30 at a desired height above the ground that is comfortable for the user. The handle angle adjustment mechanism 38 also is operable for changing the vertical angle of the handle 14 relative to the base 22 of the frame 12 and thus the height of the handlebar 30 above the ground to accommodate users of different heights.

Figure 3:
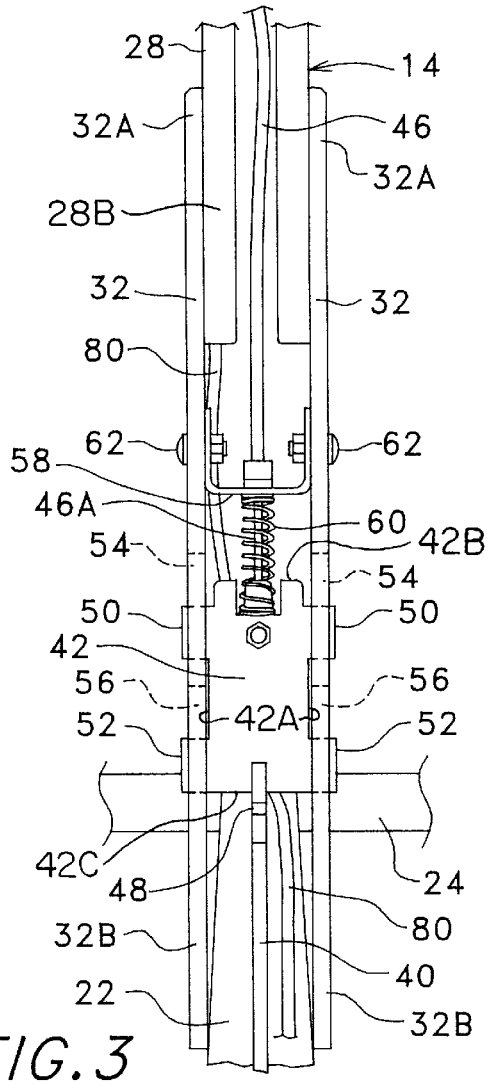
FIG. 3 is an enlarged fragmentary front elevational view of the apparatus of FIG. 1 illustrating a handle angle adjustment mechanism for changing the vertical angle of the handle relative to a frame of the apparatus, with a slidable latch of the mechanism shown in a latched position.
Figure 4:
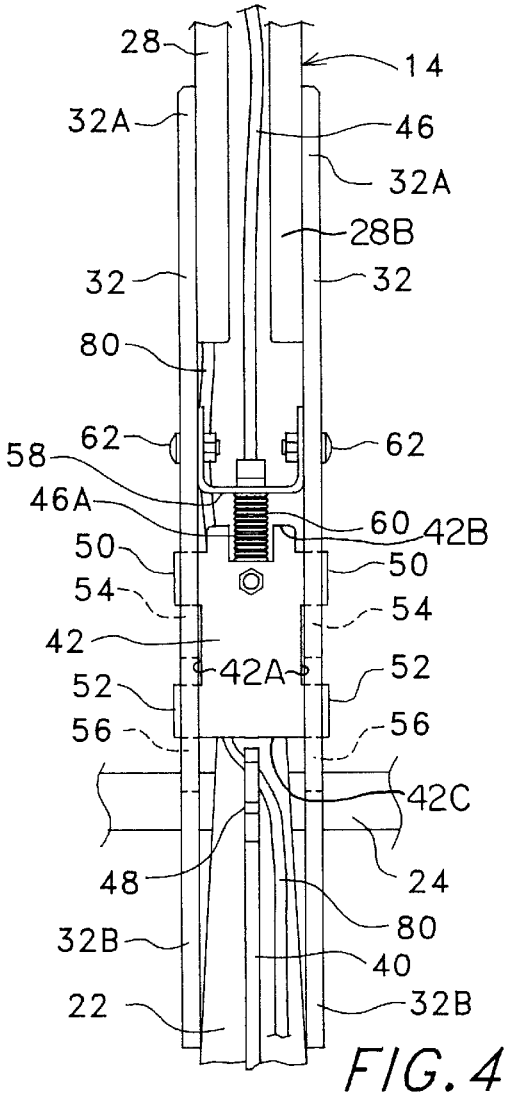
FIG. 4 is a view similar to that of FIG. 3 but with the slidable latch of the mechanism shown in an unlatched position.
Figure 2:
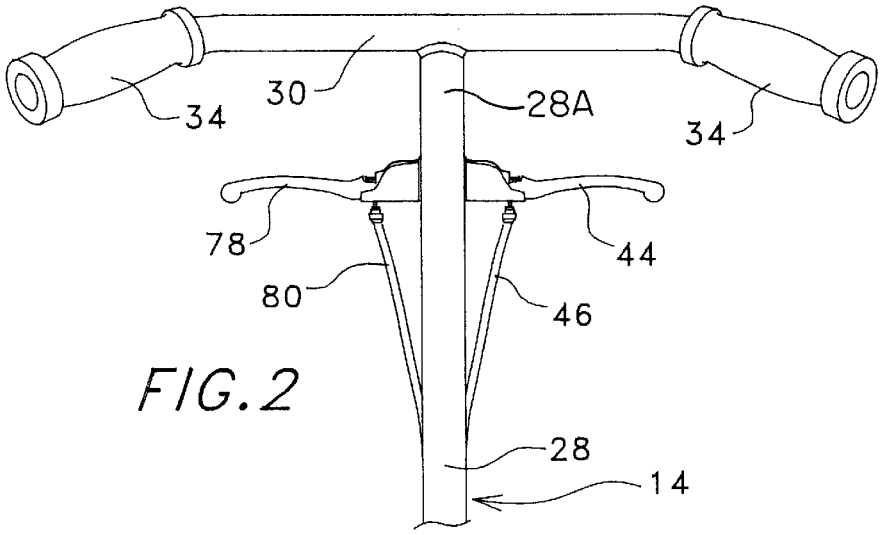
FIG. 2 is an enlarged fragmentary rear elevational view of the apparatus of FIG. 1 showing a handlebar and handle and tool angle control levers on a handle of the apparatus.

More particularly, the handle angle adjustment mechanism 38 includes a handle angle support member 40, a slidable key or latch 42, a handle angle control lever 44 and an elongated flexible member 46. The handle angle support member 40 takes the form of a rigid flat plate rigidly fixed upright upon and extending through a portion of the distance between the intermediate location of the pivotal connection of the handle 14 to the frame base 22 and the rear end 22B thereof. The handle angle support member 40 has the shape of a quarter of a circle with an arcuate-shaped outer edge portion 40A having a plurality of notches 48 defined therein and spaced apart from one another such that each notch 48 is disposed at a different vertical angle relative to the frame base 22. The latch 42 can take the form of a rigid flat plate having pairs of upper and lower side tabs 50, 52 which protrude outwardly from opposite side edges 42A of the latch 42 adjacent to upper and lower edges 42B, 42C thereof and through pairs of upper and lower slots 54, 56 formed through the side brackets 32 of the handle 14. The upper and lower slots 54, 56 are greater in length than the upper and lower side tabs 50, 52 such that the latch 42 is reciprocally and slidably movable along the handle 14 toward and away from the handle angle support member 40 between a lower latched position, as seen in FIG. 3, and an upper unlatched position, as seen in FIG. 4. In the latched position of the slidable latch 42 with the handle angle support member 40, the lower edge 42C of the latch 42 extends into a selected one of the notches 48 in the arcuate-shaped outer edge portion 40A of the handle angle support member 40. The flexible member 46, being for example a relatively stiff flexible cable, extends between and interconnects the lever 44 and the upper edge of the latch 42. It should be understood that the latch 42 can have other constructions that would correspondingly slidably mount it to the handle 14.

Figure 5:
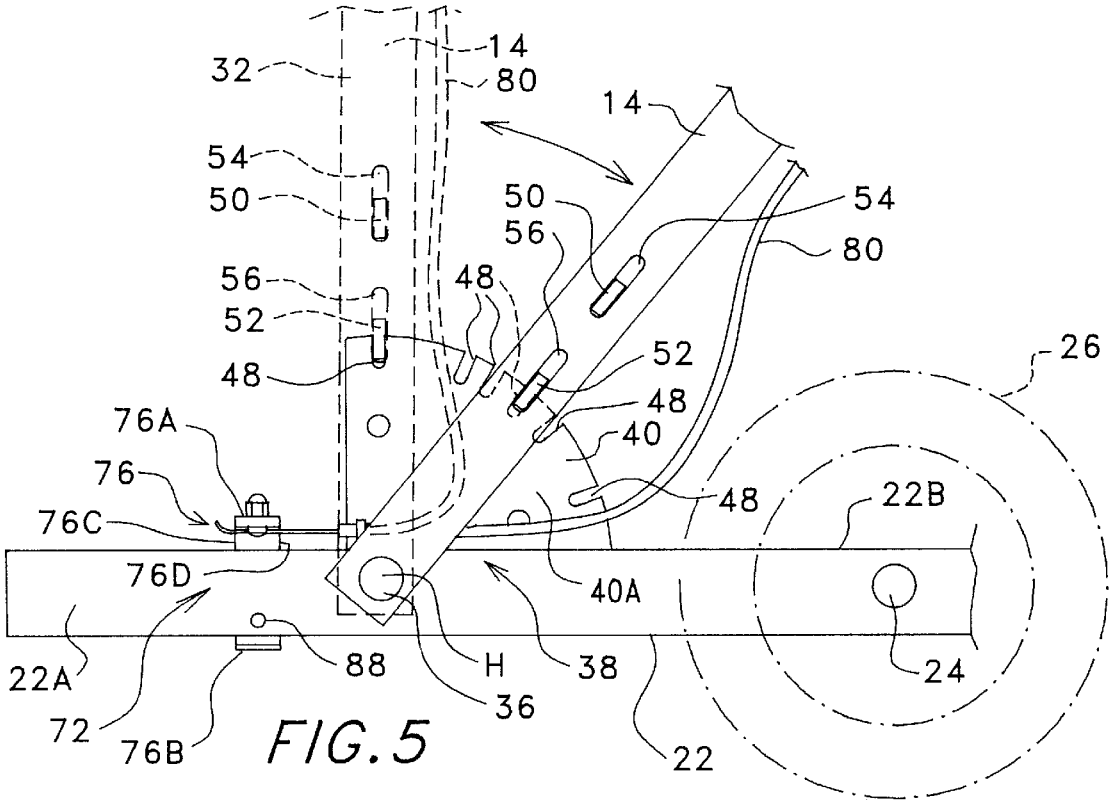
FIG. 5 is an enlarged fragmentary side elevational view of the apparatus of FIG. 1 illustrating the handle held at two different vertical angles relative to the frame.

Also, the handle angle adjustment mechanism 38 includes a bracket 58 and a coil spring 60. The bracket 58, being of generally U-shaped configuration, is disposed between and attached to the side brackets 32 of the handle 14 by fasteners 62 at a location spaced upwardly from the upper slots 54 in the side brackets 32 and thus upwardly from the upper edge 42B of the latch 42. A lower end portion 46A of the flexible member 46 extends through a hole in the bracket 58 and between the bracket 56 and the upper edge 42B of the latch 42. The coil spring 60 encircles the lower end portion 46A of the flexible member 46 and is captured between bracket 58 and the upper edge 42B of the latch 42 and normally biases and retains the latch 42 in the latched position as seen in FIG. 3. By the user pivotally moving the handle angle control lever 44 in an upward direction, the flexible member 46 is pulled upwardly causing slidable displacement of the latch 42, against the force of the coil spring 60, in an upward direction along the handle 14 from the lower latched position of FIG. 3 to the upper unlatched position of FIG. 4. By holding the handle angle control lever 44 in the upward position, the user can now move the handle 14 in the vertical plane to a selected one of the vertical angles to the frame base 22 as defined by the various notches 48 and then release the control lever 44 upon reaching the desired vertical angle which allows the latch 42 to return into engagement with the selected one of the notches 48 of the handle angle support member 40. FIG. 5 illustrate in dashed line form and solid line form two different vertical angles that the handle 14 can assume relative to the frame base 22. The handle 14 is thereby held at a desired one of the vertical angles depending upon the one of the notches 48 that is selected in the handle angle support member 40. The position of the handle 14 is latched in place by the latch 42 when the latch 42 is moved into a particular notch 48 of the handle angle support member 40. The positioning of the handle angle control lever 44 near the handlebar 30 allows operation of the handle angle adjustment mechanism 38 during movement of the apparatus 10. Except for the flexible member 46 and coil spring 60, the components of the handle mounting and adjusting means 16 are comprised of a substantially rigid material, such as metal or the like.

Referring now to FIGS. 1 and 6 to 8, the tool 18 of the apparatus 10 can be of any suitable type, such as a blade 18 as in the illustrated embodiment, and is comprised of a substantially rigid material, such as metal or the like. The blade 18 is particularly adapted for moving snow or other granular materials, such as gravel, soil or sand.

Referring to FIGS. 1, 2 and 6 to 10, the tool mounting and adjusting means 20 includes a pair of upper and lower tool or implement mounting plates 64, 66 fixedly attached by bolts 68 at the center of the rear side 18A of the tool 18 and a pivot pin 70 extending between the holes in the upper and lower mounting plates 64, 66 and in the front end 22A of the frame base 22 which is disposed between the plates 64, 66. The pivot pin 70 may a type suitable for quick removal and replacement to accommodate a variety of other attachments, tools or implements incorporating other pairs of the mounting plates 64, 66. The pivotal mounting of the mounting plates 64, 66 by the pivot pin 70 on the front end 22A of the frame base 22 allows the mounting plates 64, 66 and the tool 18 therewith to pivot in a horizontal plane along a side-to-side arc about a vertical axis V defined by the pivot pin 70.

Figure 6:
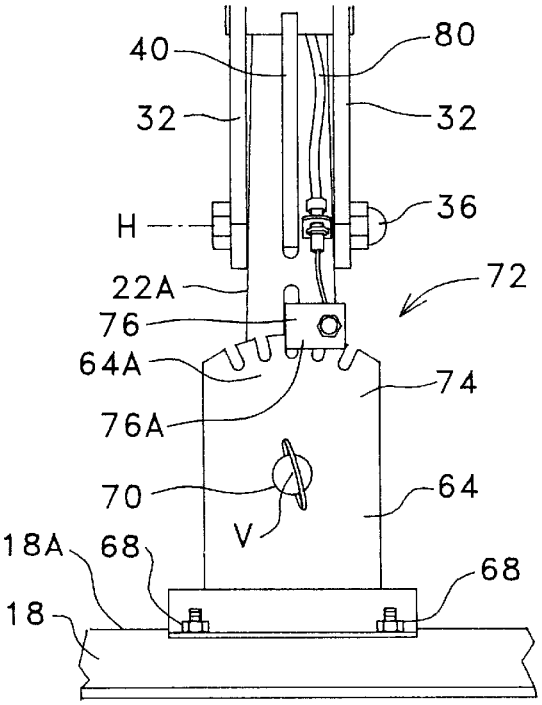
FIG. 6 is an enlarged fragmentary top plan view of the apparatus of FIG. 1 illustrating a tool angle adjustment mechanism for changing the horizontal angle of the tool relative to the frame, with a pivotal latch of the mechanism shown in a locked position and the tool shown in a centered position relative to the frame.
Figure 7:
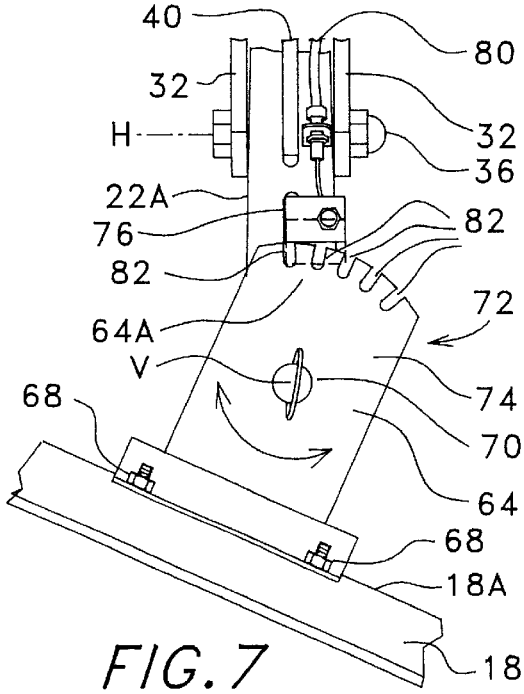
FIG. 7 is a view similar to that of FIG. 6 but with the tool shown displaced to a maximum right angular position relative to the frame.
Figure 8:
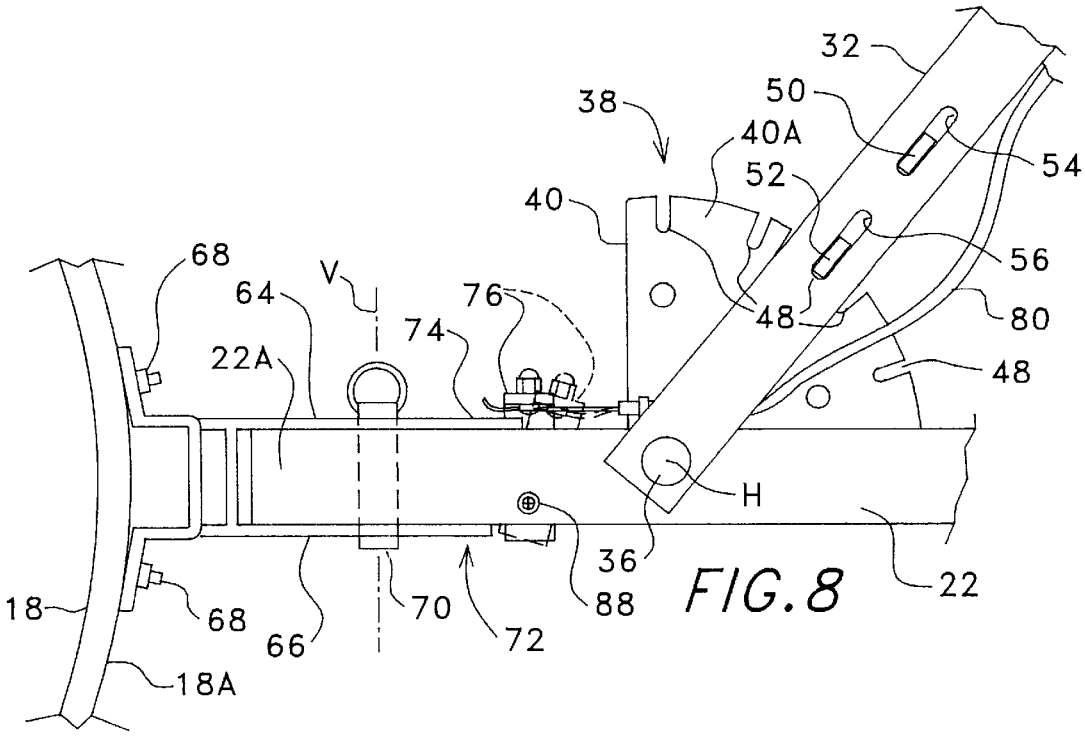
FIG. 8 is an enlarged fragmentary side elevational view of the apparatus of FIG. 1 illustrating the handle and tool angle adjustment mechanisms.
Figure 9:
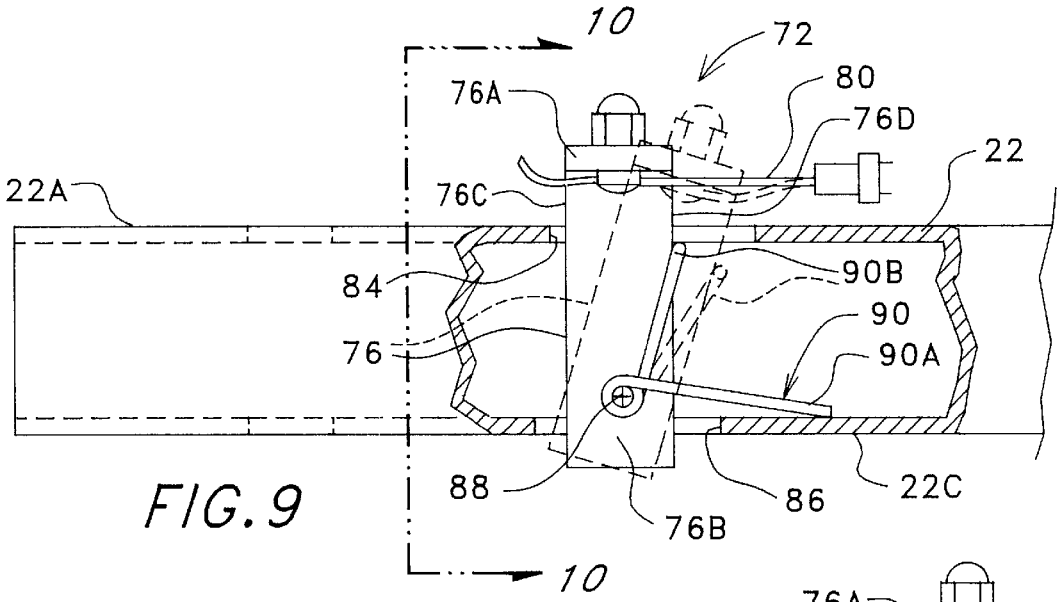
FIG. 9 is an enlarged detailed view of the pivotal latch of the tool angle adjustment mechanism of FIG. 8 illustrating the pivotal latch at its locked and unlocked positions.
Figure 10:
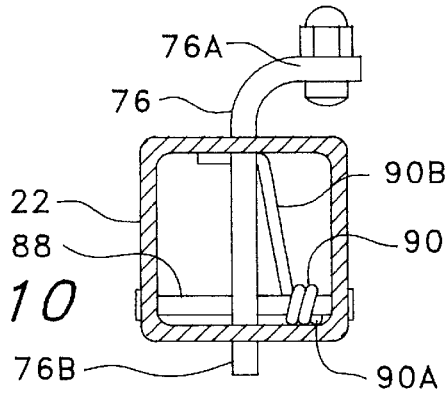
FIG. 10 is a cross-sectional view taken along line 10—10 of FIG. 9 showing a front elevational view of the pivotal latch of the tool angle adjustment mechanism.

The tool mounting and adjusting means 20 further includes a tool angle adjustment mechanism 72. The tool angle adjustment mechanism 72 includes a tool angle support member 74 in the form of an arcuate-shaped rear edge portion 64A on the upper mounting plate 64, a pivotal key or latch 76, a tool angle control lever 78 and an elongated flexible member 80 in the form of a relatively stiff flexible cable or the like. The arcuate-shaped rear edge portion 64A of the upper mounting plate 64 has a plurality of notches 82 defined therein and spaced apart from one another such that each notch 82 is disposed at a different horizontal angle relative to the frame base 22. The pivotal latch 76 takes the form of a rigid inverted J-shaped plate having upper and lower ends 76A, 76B. The latch 76 is disposed through upper and lower slots 84, 86 defined in the frame base 22 forwardly from the intermediate location on the frame base 22 where the handle 14 is pivotally mounted by the connector pin 36. The pivotal latch 76 is mounted above its lower end 76B by a pivot pin 88 extending between the opposite sides of the frame base 22 for undergoing pivotally movement between a forward locked position, as seen in solid line form in FIG. 9, and a rearward unlocked position, as seen in dashed line form in FIG. 9. In the locked position of the pivotal latch 76 with the tool angle support member 74, the front edge 76C of the latch 76 extends into a selected one of the notches 82 in the arcuate-shaped rear edge 64A of the upper mounting plate 64. The flexible member 80 extends between and interconnects the tool control angle lever 78 and the upper end 76A of the pivotal latch 76. Also, as seen in FIGS. 9 and 10, the tool angle adjustment mechanism 72 includes a torsion spring 90 disposed in the frame base 22 and mounted about the pivot pin 88. One end 90A of the spring 90 engages the bottom wall 22C of the base 22 and the other end 90B of the spring 90 engages a rear edge 76D of the pivotal latch 76 such that the pivotal latch 76 is captured therebetween and normally biases and retains the latch 76 with its front edge 76C inserted into a selected one of the notches 82. FIGS. 6 and 7 shown two different locked positions of the latch 76 with the upper mounting plate 64. By the user pivotally moving the tool angle control lever 78 in an upward direction, the flexible member 80 is pulled upwardly causing pivotal displacement of the latch 76, against the force of the torsion spring 90, in a rearward direction away from the upper mounting plate 64 from the forward locked solid line position of FIG. 9 to the rearward unlocked dashed line position of FIG. 9. By holding the tool angle control lever 78 in the upward position, the user can now maneuver the mobile frame 12 so as to pivot the tool 18 in the horizontal plane to a selected one of the horizontal angles to the frame base 22 as defined by the various notches 82 and then release the control lever 78 upon reaching the desired angle which allows the latch 76 to return into engagement with the selected one of the notches 82 of the tool angle support member 74. As mentioned above, FIGS. 6 and 7 illustrate two different horizontal angles that the tool 18 can assume relative to the frame base 22. The tool 18 is thereby held at a desired one of the horizontal angles depending upon the one of the notches 82 that is selected in the tool angle support member 74. The position of the tool 18 is locked in place by the latch 76 when the latch 76 is moved into a particular notch 82 of the tool angle support member 74. The positioning of the tool angle control lever 78 near the handlebar 30 allows operation of the tool angle adjustment mechanism 70 during movement of the apparatus 10. Except for the flexible member 80 and the torsion spring 90, the components of the tool mounting and adjusting means 20 are comprised of a substantially rigid material, such as metal or the like.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A snow shoveling apparatus, comprising:

(a) a mobile frame having an elongated base with opposite front and rear ends and wheels supporting said rear end of said base of said frame;

(b) a handle;

(c) means for mounting said handle to an intermediate portion of said base of said frame located between and spaced from said opposite front and rear ends thereof such that said handle can undergo pivotal movement between selected vertical angles relative to said base;

(d) a handle angle adjustment mechanism having one component mounted to said handle and another component mounted adjacent to said intermediate portion of said base such that said one component is adapted to undergo movement between latched and unlatched positions relative to said another component so as to allow changing of said vertical angle of said handle relative to said base when said components are in said unlatched position and to hold said handle at a selected one of said vertical angles relative to said base when said components are in said latched position;

(e) a tool; and (f) means for mounting said tool to said front end of said base of said frame opposite from said wheels supporting said rear end of said base of said frame.

2. The apparatus of claim 1 wherein said means for mounting said handle pivotally mounts a lower end of said handle to said intermediate portion of said base of said frame at a stationary location thereon such that said handle can undergo pivotal movement between selected vertical angles relative to said stationary location on said intermediate portion of said base.

3. The apparatus of claim 1 wherein:

said one component of said handle angle adjustment mechanism is movably mounted to said handle; and said another component of said handle angle adjustment mechanism is fixedly mounted on said intermediate portion of said base adjacent to said stationary location thereon such that said one component is adapted to undergo movement relative to said another component between said latched and unlatched positions.

4. A snow shoveling apparatus, comprising:

(a) a mobile frame having an elongated base with opposite front and rear ends;

(b) a handle having a pair of spaced apart lower end portions;

(c) means for mounting said handle to an intermediate portion of said base of said frame located between and spaced from said opposite front and rear ends thereof such that said handle can undergo pivotal movement between selected vertical angles relative to said base;

(d) a handle angle adjustment mechanism having one component mounted to said handle and another component mounted adjacent to said intermediate portion of said base such that said components of said handle angle adjustment mechanism are adapted to undergo relative movement between latched and unlatched positions so as to allow changing of said vertical angle of said handle relative to said base when said components are in said unlatched position and to hold said handle at a selected one of said vertical angles relative to said base when said components are in said latched position;

(e) a tool; and (f) means for mounting said tool to said front end of said base of said frame.

5. The apparatus of claim 4 wherein said means for mounting said handle to said intermediate portion of said base of said frame is a connector pin that extends through said lower end portions of said handle and said intermediate portion of said base of said frame disposed between said lower end portions of said handle, said connector pin defining a generally horizontal axis about which said handle is pivotally movable in a generally vertical plane and through said vertical angles relative to said base when said handle angle adjustment mechanism is in said unlatched position.

6. The apparatus of claim 4 wherein said one component of said handle angle adjustment mechanism is a handle angle support member fixedly mounted to and extending upwardly from said base of said frame adjacent to said intermediate portion thereof, said handle angle support member having an arcuate-shaped outer edge portion and a plurality of notches defined therein and spaced apart from one another such that each of said notches is disposed at a different one of said vertical angle relative to said base of said frame.

7. The apparatus of claim 6 wherein said other component of said handle angle adjustment mechanism is a slidable latch disposed between said lower end portions of said handle and having at least one pair side tabs which protrude outwardly from opposite side edges of said latch and through at least one pair of slots formed through said lower end portions of said handle, said slots being greater in length than said side tabs such that said latch is reciprocally and slidably movable along said lower end portions of said handle toward and away from said handle angle support member between said latched position and said unlatched position wherein said latched position a lower edge of said latch extends into a selected one of said notches in said arcuate-shaped outer edge portion of said handle angle support member.

8. The apparatus of claim 7 wherein said handle angle adjustment mechanism further includes:

a handle angle control lever pivotally mounted adjacent to said upper end of said handle; and an elongated flexible member extending between and interconnecting said handle angle control lever and said latch of said handle angle adjustment mechanism.

9. The apparatus of claim 8 wherein said handle angle adjustment mechanism further includes:

a bracket disposed between and attached to said lower end portions of said handle at a location spaced upwardly from said latch, said flexible member having a lower end portion extending through said bracket and between said bracket and said latch; and a coil spring encircling said lower end portion of said flexible member and captured between said bracket and said latch and normally biasing and retaining said latch to said latched position such that by a user pivotally moving said handle angle control lever in an upward direction said flexible member is pulled upwardly causing slidable displacement of said latch, against the force of said coil spring, in an upward direction along said handle from said latched position to said unlatched position, and by holding said handle angle control lever in said upward position, the user can now move said handle in said vertical plane to a selected one of said vertical angles to said base of said frame defined by said notches and then release said handle angle control lever upon reaching the desired angle which allows said latch to return into engagement with the selected one of said notches of said handle angle support member.

10. A snow shoveling apparatus, comprising:

(a) a mobile frame having an elongated base with opposite front and rear ends;

(b) a handle;

(c) means for mounting said handle to an intermediate portion of said base located between and spaced from said opposite front and rear ends thereof;

(d) a tool;

(e) means for mounting said tool to said front end of said base such that said tool can undergo pivotal movement between selected horizontal angles relative to said base; and (f) a tool angle adjustment mechanism having one component fixedly mounted to said tool mounting means and another component pivotally mounted to said base forwardly of said intermediate portion thereof such that said another component of said tool angle adjustment mechanism is adapted to undergo pivotal movement between locked and unlocked positions relative to said one component of said tool angle adjustment mechanism so as to allow changing of said horizontal angle of said tool relative to said base of said frame when said components are in said unlocked position and to hold said tool at a selected one of said horizontal angles relative to said base of said frame when said components are in said locked position.

11. The apparatus of claim 10 wherein said tool mounting means includes:

a pair of upper and lower mounting plates attached at a rear side of said tool; and a pivot pin extending between said upper and lower mounting plates and through said front end of said base of said frame which is disposed between said mounting plates such that said mounting plates and said tool therewith are allowed to pivot in a horizontal plane along a side-to-side arc about a vertical axis defined by said pivot pin.

12. The apparatus of claim 11 wherein said one component of said tool angle adjustment mechanism is a tool angle support member in the form of an arcuate-shaped rear edge portion on said upper mounting plate having a plurality of notches defined therein and spaced apart from one another such that each of said notches is disposed at a different horizontal angle relative to said base of said frame.

13. A snow shoveling apparatus, comprising:

(a) a mobile frame having an elongated base with opposite front and rear ends;

(b) a handle;

(c) means for mounting said handle to an intermediate portion of said base located between and spaced from said opposite front and rear ends thereof;

(d) a tool;

(e) means for mounting said tool to said front end of said such that said tool can undergo pivotal movement between selected horizontal angles relative to said base; and (f) a tool angle adjustment mechanism having one component mounted to said tool mounting means and another component mounted to said base forwardly of said intermediate portion thereof such that said components of said tool angle adjustment mechanism are adapted to undergo relative pivotal movement between locked and unlocked positions so as to allow changing of said horizontal angle of said tool relative to said base of said frame when said components are in said unlocked position and to hold said tool at a selected one of said horizontal angles relative to said base of said frame when said components are in said locked position;

(g) wherein said tool mounting means includes a pair of upper and lower mounting plates attached at a rear side of said tool and a pivot pin extending through said upper and lower mounting plates and through said front end of said base of said frame which is disposed between said mounting plates such that said mounting plates and said tool therewith are allowed to pivot in a horizontal plane along a side-to-side arc about a vertical axis defined by said pivot pin, said one component of said tool angle adjustment mechanism is a tool angle support member in the form of an arcuate-shaped rear edge portion of said upper mounting plate having a plurality of notches defined therein and spaced apart from one another such that each of said notches is disposed at a different horizontal angle relative to said base of said frame, and said other component of said tool angle adjustment mechanism is a pivotal latch disposed through said base of said frame forwardly of said intermediate portion thereof and mounted to said base by a pivot pin extending between opposite sides of said base for undergoing pivotal movement between said locked and unlocked positions of said tool angle adjustment mechanism wherein said locked position a front edge of said latch extends into a selected one of said notches in said arcuate-shaped rear edge of said upper mounting plate.

14. The apparatus of claim 13 wherein said tool angle adjustment mechanism further includes:

a tool angle control lever pivotally mounted adjacent to said upper end of said handle; and an elongated flexible member extending between and interconnecting said tool angle control lever and said latch of said tool angle adjustment mechanism.

15. The apparatus of claim 14 wherein said tool angle adjustment mechanism further includes a torsion spring disposed in said base of said frame and mounted about said pivot pin and having portions engaging said latch and said base such that said pivotal latch is captured therebetween and normally biases and retains said latch with said front edge inserted into a selected one of the notches and by a user pivotally moving said tool angle control lever in an upward direction, said flexible member is pulled upwardly causing pivotal displacement of said latch, against the force of said torsion spring, in a rearward direction away from said upper mounting plate from said locked position to said unlocked position and, by holding said tool angle control lever in said upward position, the user can now maneuver said mobile frame so as to pivot said tool in the horizontal plane to a selected one of said horizontal angles to said base of said frame as defined by said notches and then release said tool angle control lever upon reaching the desired angle which allows said latch to return into engagement with the selected one of said notches of said handle angle support member.

16. A snow shoveling apparatus, comprising:

(a) a mobile frame having an elongated base with opposite front and rear ends;

(b) a handle;

(c) means for mounting said handle to an intermediate portion of said base located between and spaced from said opposite front and rear ends thereof such that said handle can undergo pivotal movement between selected vertical angles relative to said base;

(d) a handle angle adjustment mechanism adapted to undergo relative movement between latched and unlatched positions so as to allow changing of said vertical angle of said handle relative to said base when said handle angle adjustment mechanism is in said unlatched position and to hold said handle at a selected one of said vertical angles relative to said base when said handle angle adjustment mechanism is in said latched position;

(e) a tool;

(f) means for mounting said tool to said front end of said base such that said tool can undergo pivotal movement between selected horizontal angles relative to said base; and (g) a tool angle adjustment mechanism adapted to undergo relative pivotal movement between locked and unlocked positions so as to allow changing of said horizontal angle of said tool relative to said base of said frame when said tool angle adjustment mechanism is in said unlocked position and to hold said tool at a selected one of said horizontal angles relative to said base of said frame when said tool angle adjustment mechanism is in said locked position.

17. The apparatus of claim 16 wherein said handle has a pair of spaced apart lower end portions.

18. The apparatus of claim 17 wherein said means for mounting said handle to said intermediate portion of said base of said frame is a connector pin that extends through said lower end portions of said handle and said intermediate portion of said base of said frame disposed between said lower end portions of said handle, said connector pin defining a generally horizontal axis about which said handle is pivotally movable in a generally vertical plane and through said vertical angles relative to said base when said handle angle adjustment mechanism is in said unlatched position.

19. The apparatus of claim 17 wherein said handle angle adjustment mechanism includes one component mounted to said handle and another component mounted to said intermediate portion of said base, said one component of said handle angle adjustment mechanism being a handle angle support member fixedly mounted to and extending upwardly from said base of said frame adjacent to said intermediate portion thereof, said handle angle support member having an arcuate-shaped outer edge portion and a plurality of notches defined therein and spaced apart from one another such that each of said notches is disposed at a different one of said vertical angle relative to said base of said frame.

20. The apparatus of claim 19 wherein said other component of said handle angle adjustment mechanism is a slidable latch disposed between said lower end portions of said handle and having at least one pair side tabs which protrude outwardly from opposite side edges of said latch and through at least one pair of slots formed through said lower end portions of said handle, said slots being greater in length than said side tabs such that said latch is reciprocally and slidably movable along said lower end portions of said handle toward and away from said handle angle support member between said latched position and said unlatched position wherein said latched position a lower edge of said latch extends into a selected one of said notches in said arcuate-shaped outer edge portion of said handle angle support member.

21. The apparatus of claim 20 wherein said handle angle adjustment mechanism further includes:

a handle angle control lever pivotally mounted adjacent to said upper end of said handle; and an elongated flexible member extending between and interconnecting said handle angle control lever and said latch of said handle angle adjustment mechanism.

22. The apparatus of claim 21 wherein said handle angle adjustment mechanism further includes:

a bracket disposed between and attached to said lower end portions of said handle at a location spaced upwardly from said latch, said flexible member having a lower end portion extending through said bracket and between said bracket and said latch; and a coil spring encircling said lower end portion of said flexible member and captured between said bracket and said latch and normally biasing and retaining said latch to said latched position such that by a user pivotally moving said handle angle control lever in an upward direction said flexible member is pulled upwardly causing slidable displacement of said latch, against the force of said coil spring, in an upward direction along said handle from said latched position to said unlatched position, and by holding said handle angle control lever in said upward position, the user can now move said handle in said vertical plane to a selected one of said vertical angles to said base of said frame defined by said notches and then release said handle angle control lever upon reaching the desired angle which allows said latch to return into engagement with the selected one of said notches of said handle angle support member.

23. The apparatus of claim 16 wherein said tool mounting means includes:

a pair of upper and lower mounting plates attached at a rear side of said tool; and a pivot pin extending between said upper and lower mounting plates and through said front end of said base of said frame which is disposed between said mounting plates such that said mounting plates and said tool therewith are allowed to pivot in a horizontal plane along a side-to-side arc about a vertical axis defined by said pivot pin.

24. The apparatus of claim 23 wherein said tool angle adjustment mechanism includes one component mounted to said tool mounting means and another component mounted to said base forwardly of said intermediate portion thereof, said one component being a tool angle support member in the form of an arcuate-shaped rear edge portion on said upper mounting plate having a plurality of notches defined therein and spaced apart from one another such that each of said notches is disposed at a different horizontal angle relative to said base of said frame.

25. The apparatus of claim 24 wherein said other component of said tool angle adjustment mechanism is a pivotal latch disposed through said base of said frame forwardly of said intermediate portion thereof and mounted to said base by a pivot pin extending between opposite sides of said base for undergoing pivotally movement between said locked and unlocked positions of said tool angle adjustment mechanism wherein said locked position a front edge of said latch extends into a selected one of said notches in said arcuate-shaped rear edge of said upper mounting plate.

26. The apparatus of claim 25 wherein said tool angle adjustment mechanism further includes:

a tool angle control lever pivotally mounted adjacent to said upper end of said handle; and an elongated flexible member extending between and interconnecting said tool angle control lever and said latch of said tool angle adjustment mechanism.

27. The apparatus of claim 26 wherein said tool angle adjustment mechanism further includes a torsion spring disposed in said base of said frame and mounted about said pivot pin and having portions engaging said latch and said base such that said pivotal latch is captured therebetween and normally biases and retains said latch with said front edge inserted into a selected one of the notches and by a user pivotally moving said tool angle control lever in an upward direction, said flexible member is pulled upwardly causing pivotal displacement of said latch, against the force of said torsion spring, in a rearward direction away from said upper mounting plate from said locked position to said unlocked position and, by holding said tool angle control lever in said upward position, the user can now maneuver said mobile frame so as to pivot said tool in the horizontal plane to a selected one of said horizontal angles to said base of said frame as defined by said notches and then release said tool angle control lever upon reaching the desired angle which allows said latch to return into engagement with the selected one of said notches of said handle angle support member.

28. The apparatus of claim 16 wherein said handle angle adjustment mechanism has one component movably mounted to said handle and another component fixedly mounted to said intermediate portion of said base such that said one component is adapted to undergo movement between said latched and unlatched positions relative to said another component.

29. The apparatus of claim 16 wherein said tool angle adjustment mechanism has one component fixedly mounted to said tool mounting means and another component movably mounted to said base forwardly of said intermediate portion thereof such that said another component is adapted to undergo movement between said locked and unlocked positions relative to said one component.

* * * * *